US006521056B2

(12) United States Patent
Muraki et al.

(10) Patent No.: US 6,521,056 B2
(45) Date of Patent: Feb. 18, 2003

(54) FERRITIC STAINLESS STEEL SHEET HAVING SUPERIOR WORKABILITY AT ROOM TEMPERATURES AND MECHANICAL CHARACTERISTICS AT HIGH TEMPERATURES

(75) Inventors: Mineo Muraki, Chiba (JP); Junichiro Hirasawa, Chiba (JP); Atsushi Miyazaki, Chiba (JP); Susumu Satoh, Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/911,538

(22) Filed: Jul. 25, 2001

(65) Prior Publication Data

US 2002/0036036 A1 Mar. 28, 2002

(30) Foreign Application Priority Data

Jul. 25, 2000 (JP) ..... 2000-223607

(51) Int. Cl.[7] ..... C22C 38/44; C22C 38/48
(52) U.S. Cl. ..... 148/325; 420/69
(58) Field of Search ..... 148/325, 608, 148/610; 420/69

(56) References Cited

U.S. PATENT DOCUMENTS 5,302,214 A * 4/1994 Uematsu et al. ..... 148/325
5,792,285 A 8/1998 Miyazaki et al.
5,843,370 A * 12/1998 Koyama et al. ..... 148/325

FOREIGN PATENT DOCUMENTS

| | | | |
|---|---|---|---|
| EP | 0 478 790 A1 | 4/1992 | |
| EP | 0 547 626 A1 | 6/1993 | |
| EP | 0 678 587 A1 | 10/1995 | |
| JP | 07268554 | 10/1995 | |
| JP | 10237602 | 9/1998 | |
| JP | 410273732 A * | 10/1998 | ..... C21D/9/46 |

* cited by examiner

*Primary Examiner*—Deborah Yee
(74) *Attorney, Agent, or Firm*—Young & Thompson

(57) ABSTRACT

A ferritic stainless steel sheet which has not only superior high-temperature fatigue characteristics, but also superior workability at room temperatures. The steel sheet contains, by weight percent, C: not more than 0.02%, Si: 0.2 to 1.0%, Mn: not more than 1.5%, Cr: 11.0 to 20.0%, Ni: 0.05 to 2.0%, Mo: 1.0 to 2.0%, Al: not more than 1.0%, Nb: 0.2 to 0.8%, and N: not more than 0.02%, balance essentially Fe, and an aspect ratio ($d_{RD}/d_{TD}$) of grain size in planes at ¼ and ¾ sheet thickness, seen a direction normal to a sheet surface, in the range of 1.03 to 1.35. The steel sheet has a thickness greater than 0.3 mm but not greater than 2.5 mm, and a yield strength Y.S.≦360 MPa and an r-value≧1.3 at 30° C., and wherein after maintaining the steel sheet at 900° C. for one hour, the Y.S.≧18.0 MPa.

7 Claims, 5 Drawing Sheets

$$d_{TD} = \frac{L_{TD}\ (\text{LINE LENGTH})}{n_{TD}\ (\text{NUMBER OF GRAINS})} \qquad d_{RD} = \frac{L_{RD}\ (\text{LINE LENGTH})}{n_{RD}\ (\text{NUMBER OF GRAINS})}$$

FERRITIC STAINLESS STEEL SHEET HAVING SUPERIOR WORKABILITY AT ROOM TEMPERATURES AND MECHANICAL CHARACTERISTICS AT HIGH TEMPERATURES

BACKGROUND OF THE INVENTION

1. Field of the Invention

The present invention relates to a ferritic stainless steel sheet which has superior workability at room temperatures and mechanical characteristics at high temperatures, and a method of producing the same. More particularly, the present invention relates to a ferritic stainless steel sheet which is suitable for use in, e.g., an automobile part in the exhaust system, specifically an exhaust manifold, which is manufactured under severe working conditions in two or more working steps, such as the steps of forming a pipe by welding, bending it and enlarging the pipe diameter, and which undergoes a load repeatedly while being heated to high temperatures of not lower than 800° C. by exhaust gas from an engine and which is subjected to heavy vibrations from the engine, as well as a method of producing the ferritic stainless steel sheet.

2. Description of the Related Art

Ferritic stainless steel has a smaller coefficient of thermal expansion than austenitic stainless steel, and has advantages that the problem of thermal strain resulting when used in an environment subjected to high temperatures and low temperatures alternately is relatively insignificant, and that oxidation resistance at high temperatures is superior. However, ferritic stainless steel has a problem in workability when worked for shaping at room temperatures.

Various alloy elements are added to, in particular, a member used in a high-temperature environment, such as an exhaust manifold, for the purpose of increasing the strength at high temperatures. Generally, addition of various alloy elements at high rates, on one side, increases the strength at high temperatures and improves high-temperature fatigue characteristics and thermal fatigue characteristics, but on the other hand, increases the hardness and strength in working and decreases drawing formability represented by the r-value. These disadvantages make it more difficult to form a steel sheet into a complicated shape.

As one solution for overcoming the problems described above, Japanese Unexamined Patent Application No. 4-228540 proposes ferritic stainless steel in which an appropriate amount of Co is contained in Nb—Mo—(Ti) added steel to improve the strength at high temperatures without causing an increase in the strength at room temperature. With the proposed ferritic stainless steel, the tensile strength (referred to as the "T.S." hereinafter) at about 850° C. increases noticeably.

With recent increasing technical demands for further improvements in eco-friendliness and fuel consumption efficiency, however, the temperature at which the exhaust manifold is employed has risen to a level over 850° C. In other words, conventional materials are no longer adapted for such a high-temperature environment because of the insufficient strength at high temperatures.

FIG. 1 shows results of measuring changes over time in the strength (Y.S. or yield strength corresponding to a tension set of 0.2% at a strain rate of 0.3%/min) of the above-described conventional ferritic stainless steel at 900° C.

As will be seen from FIG. 1, when the conventional steel is heated to high temperatures of 900° C. or above, it has sufficient strength immediately after reaching such a high-temperature level. However, when holding the conventional steel at a high-temperature for a long time, the Y.S. is gradually reduced over time.

Thus, because the conventional steel does not endure a high-temperature range of 900° C. or above for a long time, there has been a demand for development of a novel material that is highly excellent in both of strength at high temperatures and workability at room temperatures.

SUMMARY OF THE INVENTION

With a view toward satisfying the above-mentioned demand, it is an object of the present invention to provide a ferritic stainless steel sheet which has superior high-temperature fatigue characteristics, strength at high temperatures when the sheet is maintained at high temperatures for a long time, and workability at room temperatures, and to provide a method that is advantageous for producing the ferritic stainless steel sheet.

It is to be noted that the term "steel sheet" in this specification includes steel strips or hoops.

More specifically, the present invention is characterized as follows.

According to one aspect of the present invention, the stainless steel sheet has a composition containing, by weight, C: not more than 0.02%, Si: 0.2 to 1.0%, Mn: not more than 1.5%, Cr: 11.0 to 20.0%, Ni: 0.05 to 2.0%, Mo: 1.0 to 2.0%, Al: not more than 1.0%, Nb: 0.2 to 0.8%, and N: not more than 0.02%, balance essentially Fe, and an aspect ratio ($d_{RD}/d_{TD}$) of grain size in planes at ¼ and ¾ sheet thickness, seen in a direction normal to a sheet surface, that satisfies the following formula;

$$1.03 \leqq (d_{RD}/d_{TD}) \leqq 1.35$$

where $d_{RD}$: average grain size in a rolling direction (RD direction) seen in a direction normal to the sheet surface, and $d_{TD}$: average grain size in a transverse direction (TD direction) perpendicular to the RD direction seen in a direction normal to the sheet surface.

In the above ferritic stainless steel sheet, preferably, the steel sheet has a thickness of greater than 0.3 mm but not greater than 2.5 mm, and a strength Y.S.≦360 MPa and an r-value≧1.3 at 30° C., and after maintaining the steel sheet at 900° C. for one hour, the Y.S.≧18.0 MPa.

In the above ferritic stainless steel sheet, preferably, P+S≦0.05 wt %.

Preferably, the steel sheet has a composition further containing, by weight, one or more of Ti: 0.05 to 0.5%, Zr: 0.05 to 0.5%, and Ta: 0.05 to 0.5%.

Preferably, the steel sheet has a composition further containing, by weight, Cu: 0.1 to 2.0%.

Preferably, the steel sheet has a composition further containing, by weight, one or more of W: 0.05 to 1.0% and Mg: 0.001 to 0.1%.

Preferably, the steel sheet has a composition further containing, by weight, Ca: 0.0005 to 0.005%.

According to another aspect of the present invention, there is provided a method of producing a ferritic stainless steel sheet which has superior workability at room temperatures and mechanical characteristics at high temperatures, the method comprising the steps of hot- rolling a steel ingot in a tandem rolling mill, the steel ingot having a composition containing, by weight, C: not more than 0.02%, Si: 0.2 to 1.0%, Mn: not more than 1.5%, Cr: 11.0 to 20.0%, Ni: 0.05 to 2.0%, Mo: 1.0 to 2.0%, Al: not more than 1.0%, Nb: 0.2 to 0.8%, and N: not more than 0.02%, a balance essentially Fe; annealing the resulting hot-rolled sheet; cold-rolling the annealed sheet once or more with intermediate annealing; and finish-annealing the cold-rolled sheet, the hot-rolling step being controlled such that the total reduction in thickness during passage through final two stands of the mill during finish hot rolling is not less than 25%, the elapsed time of passage through the final two stands is not more than 1.0 second, and the linear pressure in the final pass is not lower than 15 MN/m, the step of annealing the hot-rolled sheet being carried out at temperatures of 800 to 1050° C., a final pass in the cold-rolling step being carried out under conditions of a sheet temperature of 80 to 200° C. and the coefficient of friction of 0.01 to 0.2. "Linear pressure" denotes rolling load per unit width of the hot-rolled sheet.

In the above method, preferably, the cold rolling step is carried out such that the steel sheet has a thickness of greater than 0.3 mm but not greater than 2.5 mm.

Preferably, the steel sheet has a composition further containing, by weight, one or more of Ti: 0.05 to 0.5%, Zr: 0.05 to 0.5%, and Ta: 0.05 to 0.5%.

Preferably, the steel sheet has a composition further containing, by weight, Cu: 0.1 to 2.0%.

Preferably, the steel sheet has a composition further containing, by weight, one or more of W: 0.05 to 1.0% and Mg: 0.001 to 0.1%.

Preferably, the steel sheet has a composition further containing, by weight, Ca: 0.0005 to 0.005%.

DESCRIPTION OF THE PREFERRED EMBODIMENTS

Figure 1:
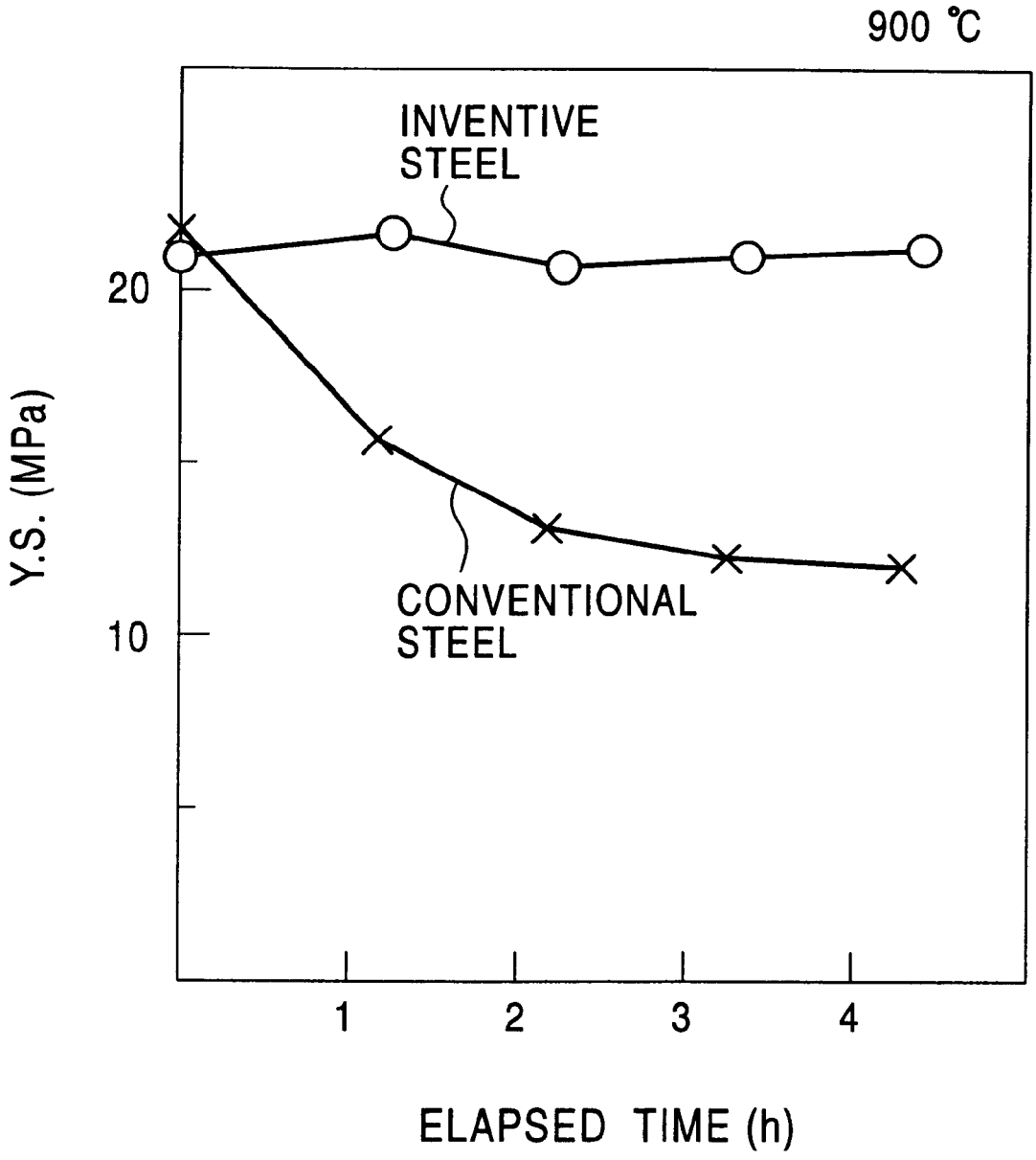
FIG. 1 is a graph showing comparatively changes over time in the strength (Y.S.) of ferritic stainless steel according to a conventional method and the inventive method at 900° C.

As a result of conducting intensive studies with a view toward achieving the object set forth above, the inventors have found that the intended object can be advantageously achieved by properly controlling the form of precipitates and the crystal structure of ferritic stainless steel having certain compositions.

The present invention is based on the above finding.

Ferritic stainless steel according to the present invention (referred to simply as "inventive steel" hereinafter) will be described below in more detail.

The reasons why the composition of the inventive steel is limited to the ranges mentioned above.will now be given. Note that, in the following description, % means weight percentage if not otherwise specified.

C: not more than 0.02%

In the inventive steel, if the C content exceeds 0.02%, the corrosion resistance is decreased. The C content is therefore limited to be not more than 0.02%.

Si: 0.2 to 1.0%

Si is an element useful in increasing the strength and improving the oxidation resistance. This effect contributes to improving the high-temperature fatigue characteristics. To obtain these effects, a Si content of not less than 0.2% is required, but if it exceeds 1.0%, the strength at high temperatures would be noticeably lowered. The Si content is therefore limited to the range of 0.2% to 1.0%. From the standpoint of ensuring stable strength at high temperatures, the Si content is preferably not more than 0.6%.

Mn: not more than 1.5%

Mn is effective in improving the oxidation resistance, and therefore it is an element required in a material used at high temperatures. From that point of view, Mn is preferably present in amount not less than 0.1%. However, if Mn is in excess, the toughness of the steel would be decreased and the production of steel would be difficult to carry out because of, e.g., cracking occurring during cold rolling. The Mn content is therefore limited to not more than 1.5%.

Cr: 11.0 to 20.0%

Cr is effective in increasing the strength at high temperatures, the oxidation resistance, and the corrosion resistance. The Cr content of not less than 11.0% is essential to obtain satisfactory levels of the strength at high temperatures, the oxidation resistance, and the corrosion resistance. On the other hand, Cr acts to decrease the toughness of steel. In particular, if the Cr content exceeds 20.0%, the toughness would be noticeably decreased, thus accelerating decrease over time of the strength at high temperatures. The Cr content is therefore limited to the range of 11.0 to 20.0%. In particular, the Cr content is preferably to be not less than 14.0% from the standpoint of improving the high-temperature fatigue characteristics, and to be not more than 16.0% from the standpoint of ensuring good workability.

Ni: 0.05 to 2.0%

Ni contributes to improving the corrosion resistance that is a specific feature of stainless steel. The Ni content is therefore required to be not less than 0.05%. However, if the Ni content exceeds 2.0%, the hardness of the steel would be too greatly increased, thus resulting in an adverse effect upon workability.

Mo: 1.0 to 2.0%

Mo is effective in increasing the strength at high temperatures and the corrosion resistance. The Mo content of not less than 1.0% is required to obtain satisfactory levels of the strength at high temperatures and the corrosion resistance. On the other hand, if the Mo content exceeds 2.0%, the toughness would be noticeably decreased and decrease over time of the strength at high temperatures would be accelerated. The Mo content is therefore limited to the range of 1.0 to 2.0%. Preferably, the Mo content is to be not less than 1.5% from the standpoint of improving the high-temperature fatigue characteristics.

Al: not more than 1.0%

Al is an element required as a deoxidizer in the steel producing process. However, addition of Al in an excessive amount would deteriorate the surface properties due to generation of inclusions. The Al content is therefore limited to not more than 1.0%.

Nb: 0.2 to 0.8%

Nb is an element effective in increasing the strength at high temperatures. The Nb content of at least 0.2% is required to obtain a satisfactory level of the strength at high temperatures. On the other hand, if the Nb content exceeds 0.8%, the toughness would be decreased and a decrease over time of the strength at high temperatures would be accelerated. The Nb content is therefore limited to the range of 0.2 to 0.8%. In particular, the Nb content is preferably not less than 0.4% from the standpoint of improving the high-temperature fatigue characteristics, and not more than 0.6% from the standpoint of developing stable characteristics at high temperatures.

N: not more than 0.02%

If the N content exceeds 0.02%, it would precipitate in the form of nitride at the grain boundary, thereby adversely affecting workability. The N content is therefore limited to not more than 0.02%.

Although the contents of essential ingredients of the inventive steel have been described above, the inventive steel may further contain any of the following elements as required.

Ti: 0.05 to 0.5%, Zr: 0.05 to 0.5%, and Ta: 0.05 to 0.5%

Ti, Zr and Ta are each useful to precipitate in the form of carbide under application of heat during welding. This precipitation hardening effect contributes to improving the high-temperature fatigue characteristics. Accordingly, these elements are each required to be contained in amount of not less than 0.05%. However, if the content of each element exceeds 0.5%, the effect would be saturated, and in addition the surface properties of a resulting steel sheet would be noticeably deteriorated. The content of each element is therefore to be not more than 0.5%.

Cu: 0.1 to 2.0%

Cu is an element useful in improving the corrosion resistance and the toughness of steel. Accordingly, Cu is required to be present in amount of not less than 0.1%. However, if the Cu content exceeds 2.0%, the workability of steel would be decreased. The Cu content is therefore to be at most 2.0%.

W: 0.05 to 1.0% and Mg: 0.001 to 0.1%

W and Mg are each elements useful in improving the high-temperature fatigue characteristics. Accordingly, these elements are required to be contained in an amount of not less than 0.05% and not less than 0.001%, respectively. However, if the W and Mg contents exceed 1.0% and 0.1%, respectively, the toughness of the steel would be decreased and the resistance to secondary work embrittlement in the weld would also be decreased. These elements are therefore contained in the above-mentioned respective ranges.

Ca: 0.0005 to 0.005%

Ca is effective in preventing a nozzle from being clogged with a Ti-based inclusion during casting of a slab, and for this reason it is added as needed. Accordingly, Ca should be present in amount not less than 0.0005%. However, if the Ca content exceeds 0.005%, the resulting effect would be saturated, and in addition the corrosion resistance would be decreased because a Ca-containing inclusion would cause the start of pitting corrosion. The Ca content is therefore to be not more than 0.005%.

In the inventive steel, the balance consists essentially of Fe.

Herein, the expression "balance essentially Fe" means that, in addition to Fe, trace amounts of alkali metals, alkaline earth metals, rare earth elements, transition metals, etc. may be contained in the steel. Even if the inventive steel contains any of those elements, the advantages of the present invention will not be impaired.

Further, other impurities such as S and P may be contained in the inventive steel. For these elements, $(P+S) \leqq 0.05\%$ is preferably satisfied. The reason is that when (P+S) is not more than 0.05%, an aspect ratio, described below, can be controlled so as to fall in a desired range more satisfactorily.

In the present invention, an adjustment of the steel composition to the respective ranges described above is insufficient by itself, and control of the steel structure after cold rolling and annealing is additionally required.

More specifically, it is important that the steel structure after cold rolling and annealing be controlled to make an aspect ratio ($d_{RD}/d_{TD}$) of grain size in planes at ¼ and ¾ sheet thickness, seen a direction normal to a sheet surface, satisfy the following relationship:

$$1.03 \leqq (d_{RD}/d_{TD}) \leqq 1.35$$

Figure 2:
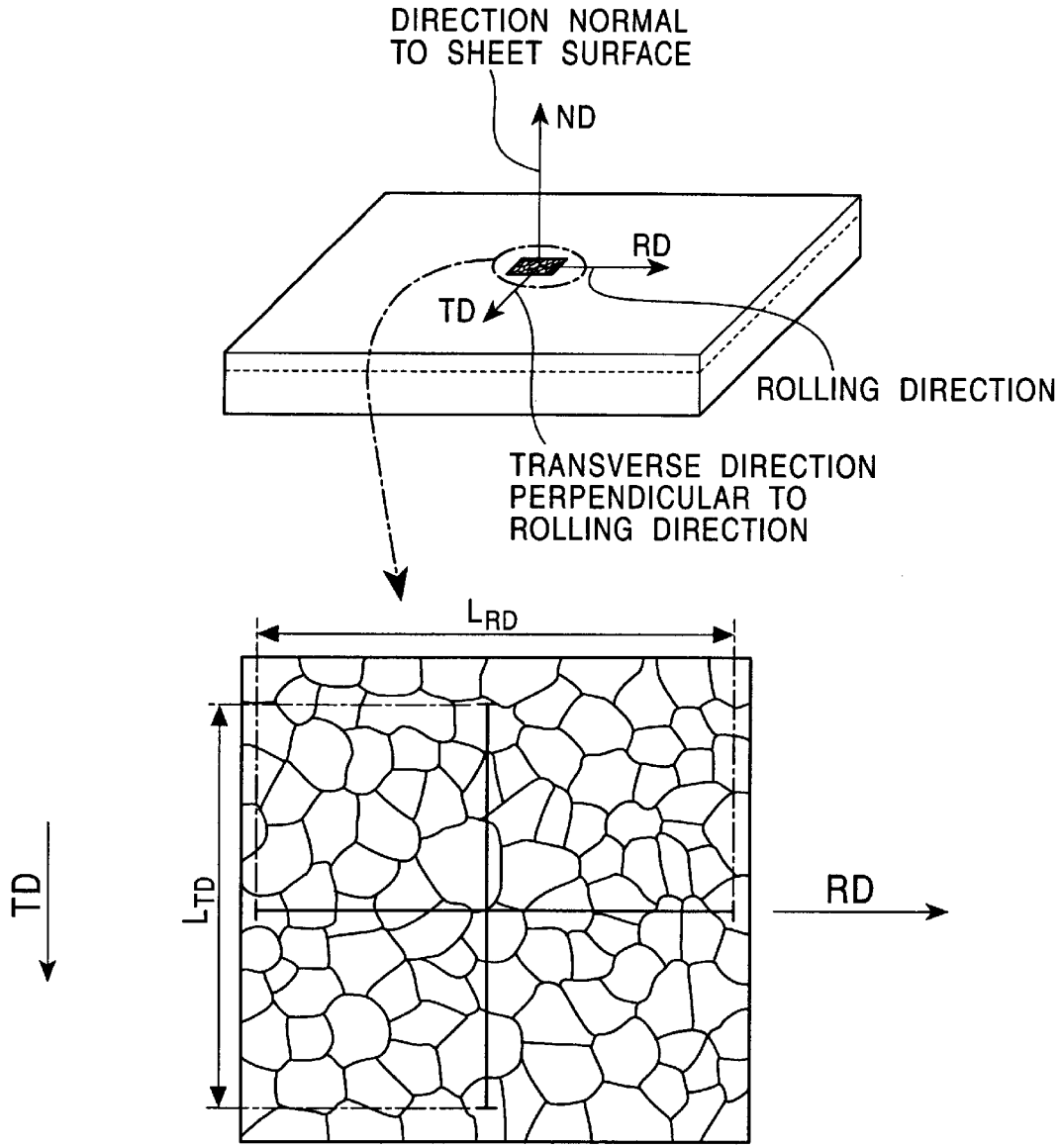
FIG. 2 is an explanatory view for explaining the rolling direction (RD direction) and the transverse direction (TD direction) perpendicular to the RD direction.

In the relationship shown in FIG. 2, $d_{RD}$ represents the average grain size in the rolling direction (RD direction) seen in a direction normal to the sheet surface, and $d_{TD}$ represents the average grain size in a transverse direction (TD direction) perpendicular to the RD direction seen in a direction normal to the sheet surface. The average grain size was determined by evaluating a structure photograph by the segment method. Namely, two straight lines were drawn one in each of the RD and TD directions so as to extend over about 100 grains, and the quotients resulting from dividing lengths of the straight lines by the numbers of segments, corresponding to parts of the straight lines demarcated by the grain boundaries, were calculated as typical values $d_{RD}$, $d_{TD}$ of the grain sizes in the respective directions. Then, the aspect ratio (degree of elongation) of grain size in the RD direction to grain size in the TD direction was determined from the ratio of $d_{RD}/d_{TD}$.

Figure 3:
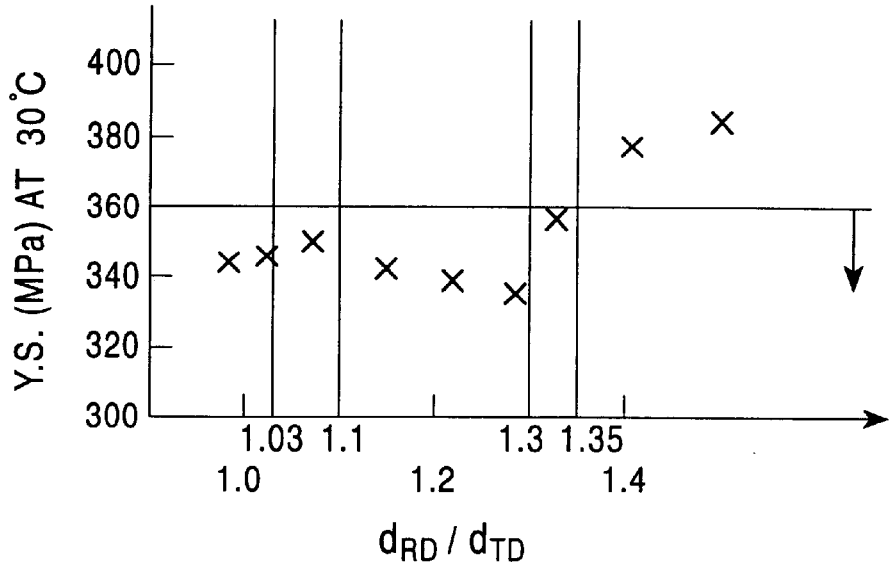
FIG. 3 is a graph showing the relationship between the aspect ratio ($d_{RD}/d_{TD}$) of grain size and the Y.S. at 30° C.
Figure 4:
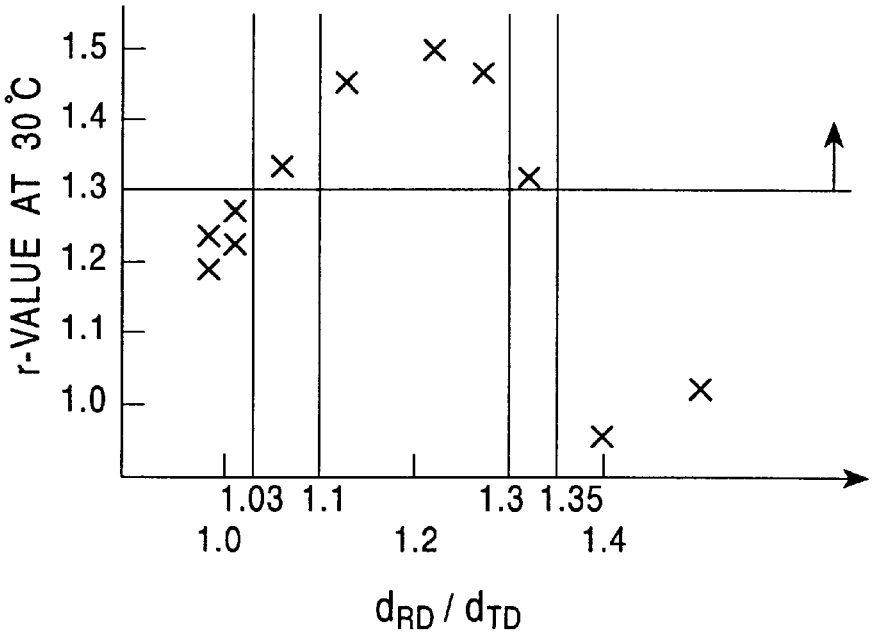
FIG. 4 is a graph showing the relationship between the aspect ratio ($d_{RD}/d_{TD}$) of grain size and r-value.
Figure 5:
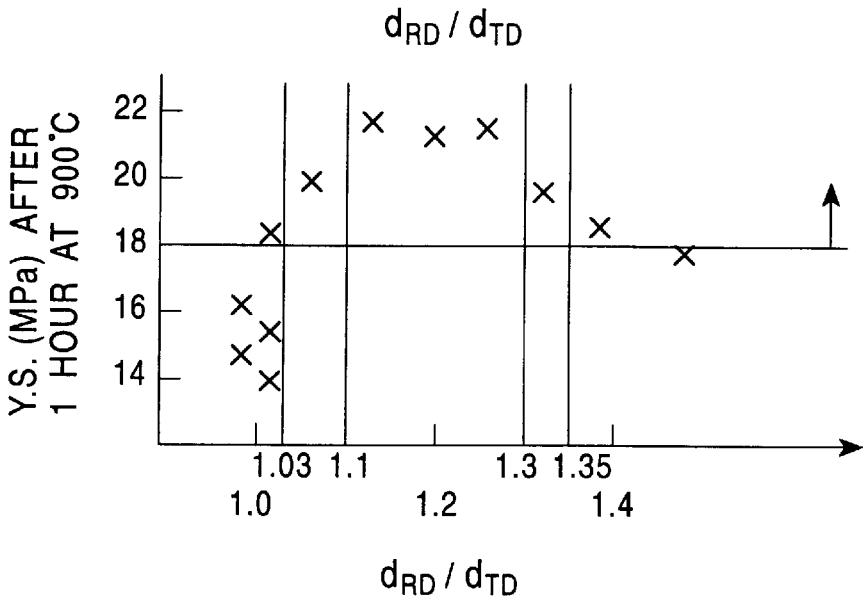
FIG. 5 is a graph showing the relationship between the aspect ratio ($d_{RD}/d_{TD}$) of grain size and the Y.S. after maintaining a steel sheet at 900° C. for one hour.

FIGS. 3 to 5 show results obtained by measuring the relationship between the aspect ratio ($d_{RD}/d_{TD}$) and the Y.S. at 30° C. (FIG. 3), the relationship between the aspect ratio ($d_{RD}/d_{TD}$) and the r-value (FIG. 4), and the relationship between the aspect ratio ($d_{RD}/d_{TD}$) and the Y.S. after maintaining a steel sheet at 900° C. for one hour (FIG. 5), respectively, when the aspect ratio was variously changed by varying production conditions of the inventive steel, i.e., the steel having a composition containing C: 0.006%, Si: 0.28%, Mn: 0.2%, Cr: 15.5%, Ni: 0.7%, Mo: 1.6%, Al: 0.06%, Nb: 0.44%, and N: 0.007%, balance essentially Fe.

As shown in FIGS. 3 to 5, when $d_{RD}/d_{TD}$ satisfies the range of 1.03 to 1.35, the Y.S. at 30° C. is not more than 360 MPa, the Y.S. resulting after maintaining the steel sheet at 900° C. for one hour is not less than 18.0 MPa, and the r-value at 30° C. is not less than 1.3. That is, satisfactory values are obtained in achieving desired levels of the workability at room temperatures and the strength at high temperatures.

On the other hand, if $d_{RD}/d_{TD}$ is less than 1.03, a disadvantage would occur in that the strength at high temperatures is noticeably decreased. Conversely, if $d_{RD}/d_{TD}$ exceeds 1.35, the r-value would be reduced, and in addition a problem would arise in the workability at room temperatures.

In more detail, the following facts were found from the studies conducted by the inventors. As the aspect ratio has a smaller value and approaches 1.0, the r-value is increased and the Y.S. at room temperatures is reduced, thus resulting in improved workability. However, stability of the strength at high temperatures over time is reduced, and surface properties, such as surface roughness, and surface oxidation characteristics are noticeably deteriorated. On the contrary, as the aspect ratio has a greater value, the Y.S. is excessively increased and the r-value is reduced, thus resulting in decreased workability. Furthermore, the in-plane anisotropy of workability is increased and the r-value in the rolling direction is noticeably reduced. This may cause such the difficulty in the forming step that end surfaces of pressed steel sheets are not aligned with each other.

Those findings show the importance of controlling the aspect ratio so as to fall in the proper range defined in the present invention. In particular, the aspect ratio is more preferably in the range of $1.1 \leqq (d_{RD}/d_{TD}) \leqq 1.3$ in planes at ¼ and ¾ sheet thickness.

The reasons why the aspect ratio should be determined from the observation of planes at ¼ and ¾ sheet thickness are given below. Because the steel structure in such a plane is not affected by segregation occurring in a core portion during casting and is less subject to the effect on a region near the surface from, e.g., the atmosphere during annealing, better correlation between the aspect ratio and other characteristics, such as the r-value and the strength at high temperatures as a whole of steel material, can be obtained.

Furthermore, the term "r-value (Lankford value)" used herein means the average plastic strain ratio determined in conformity with JIS Z2254. More specifically, a specimen JIS No. 13-B was sampled from a steel sheet after cold rolling and the annealing in each of the rolling direction (L direction), the transverse direction (T direction) perpendicular to the rolling direction, and the diagonal direction (D direction) inclined at 45° from the rolling direction. The r-value of the specimen in each direction was measured from the ratio of width strain to thickness strain resulting when a simple tensile pre-strain of 15% was applied to the steel sheet. The average plastic strain ratio, i.e., the r-value, was then determined from the following equation:

$$\text{r-value}=(r_L+2r_D+r_T)/4$$

where $r_L$, $r_D$ and $r_T$ represent the r-values in the L, D and T directions, respectively.

Figure 6:
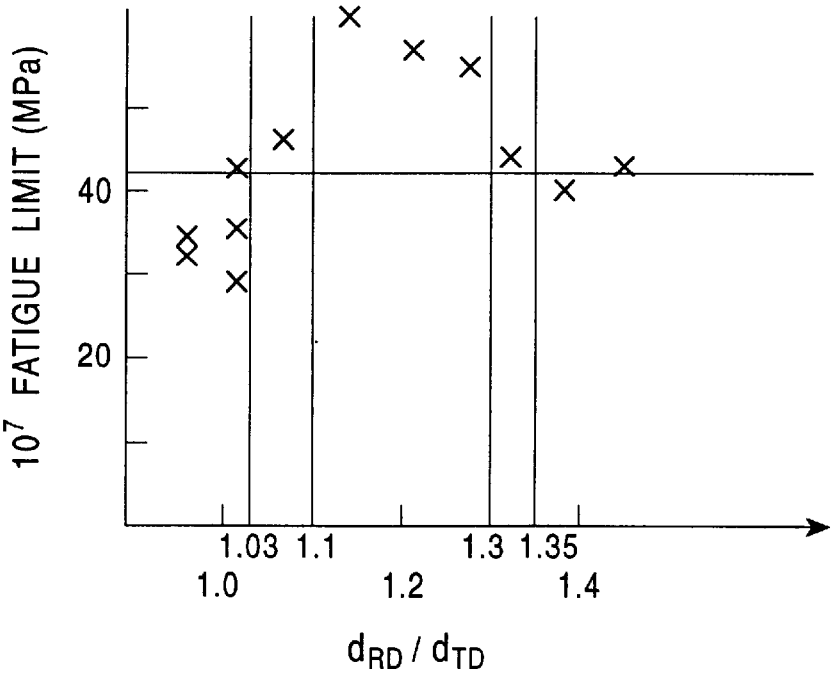
FIG. 6 is a graph showing the relationship between the aspect ratio ($d_{RD}/d_{TD}$) of grain size and high-temperature fatigue characteristics.

FIG. 6 shows results obtained from measuring the relationship between the aspect ratio ($d_{RD}/d_{TD}$) of grain size and high-temperature fatigue characteristics.

Figure 7:
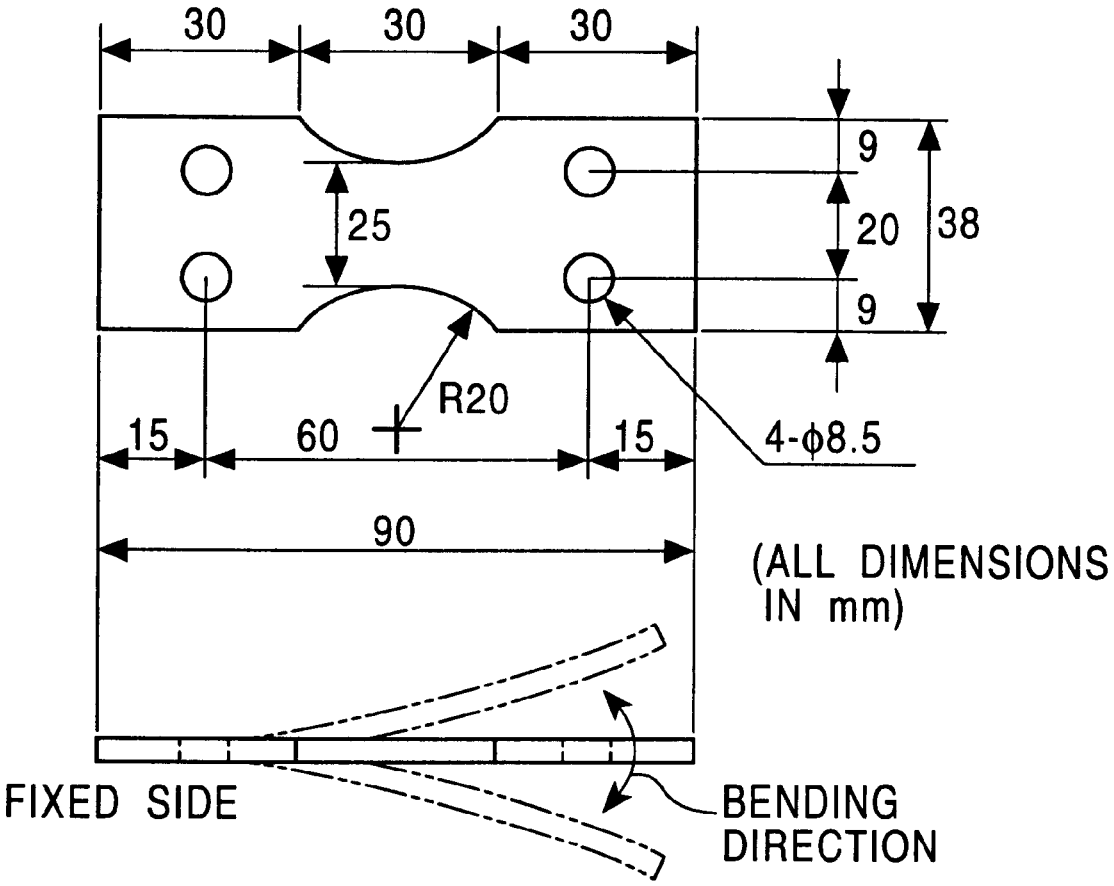
FIG. 7 is an explanatory view showing the dimensions and shape of a specimen used in a high-temperature fatigue test and explaining the test procedure.

A high-temperature fatigue test was performed on specimens having various values of the aspect ratio of grain size. More specifically, a repeated bending test (with completely reversed bending) at 900° C. was carried out in conformity with JIS Z2275 by using those specimens each having dimensions and a shape shown in FIG. 7, and measuring a $10^7$ fatigue limit (maximum bending stress at which no fatigue cracks occur even after repeating the bending $10^7$ times). Herein, a bending stress σ means a value resulting from measuring the bending moment M (Nm) in a section that produces a maximum stress (section at a TIG welding bead in FIG. 7) when a bending deformation is applied to the specimen, and dividing the measured moment by the section modulus. As shown in FIG. 6, when the aspect ratio ($d_{RD}/d_{TD}$) satisfies the range of 1.03 to 1.35, improved high-temperature fatigue characteristics are obtained with the $10^7$ fatigue limit being 42 MPa or above.

The reason why superior characteristics at high temperatures, especially stability over time of the strength at high temperatures and a high $10^7$ fatigue limit, are obtained by controlling the aspect ratio as described above, is not fully known, but the views on that point of the inventors are as follows. When a material has an excessive aspect ratio, a large strain remains in a steel sheet and this residual strain results in the (Fe, Cr, Si) $(Mo, Nb, V, W)_2$-based Laves phase being precipitated in an excessive amount. As a result, the amount of solid solution Mo, for example, which is important in improving the strength at high temperatures and the fatigue characteristics, becomes insufficient. On the other hand, when the aspect ratio is too small, grain growth is noticeably accelerated while the steel sheet is maintained at high temperatures, and during this growing process solid solution Mo is likewise lost as precipitates, thus resulting in a reduction in both the strength at high temperatures and the fatigue characteristics.

As will be described later, the aspect ratio in the above range can be achieved by not only properly controlling the hot rolling conditions and the annealing conditions for a hot-rolled sheet, but also selecting the proper cold rolling conditions.

Additionally, in applications of the inventive steel to an exhaust manifold or the like, if the steel sheet has a thickness of not greater than 0.3 mm, the absolute strength of the steel sheet would be insufficient, as such a material should have high strength at high temperatures of 850° C. or above. For that reason, the thickness of the steel sheet is to be greater than 0.3 mm. On the other hand, an upper limit of the sheet thickness is 2.5 mm from the standpoint of ensuring a sufficient reduction in thickness during the cold rolling. When trying to produce a cold-rolled sheet having a thickness greater than 2.5 mm, the thickness of a hot-rolled sheet as a base sheet must be increased for ensuring a required reduction in thickness during the cold rolling. This may cause rupture of the weld because the bending force imposed upon the weld at a bending position (such as a bridle roll) is increased proportionally as the sheet thickness increases when the steel sheets passes a continuous line for the annealing and pickling of the hot-rolled sheet. If the inventive steel is employed in another application, e.g., the field of materials for fuel cells in which corrosion resistance at high temperatures is required as a main characteristic, the sheet thickness is not limited to the above-mentioned range.

Preferred conditions for producing the inventive steel will be described below.

In the steel-making stage, conditions are not limited to particular ones and the method generally employed in producing ferritic stainless steel can be practiced. For example, the inventive steel is preferably produced by a method of making ingot steel having a composition in the above-described desired range with a converter, an electric furnace, or the like, and performing secondary smelting of the ingot steel with VOD (Vacuum Oxygen Decarburization).

A steel material can be obtained from the resulting ingot steel by any of known casting methods, but it is preferable to employ the continuous casting method from the standpoints of productivity and quality.

The obtained steel material is heated to a temperature of about 1000 to 1250° C. and then subjected to hot rolling. A hot-rolled sheet having a predetermined thickness is thereby produced. The hot-rolled sheet is annealed by continuous annealing preferably at a temperature of 800 to 1050° C., and then subjected to pickling. Subsequently, cold rolling is performed on the annealed sheet once or more including intermediate annealing to obtain a cold-rolled sheet. The cold-rolled sheet is subjected to finish annealing at a temperature of 650 to 1150° C., preferably 900 to 1100° C., for an annealing time of 10 to 300 seconds. A final product is then obtained after pickling.

In the present invention, when the hot rolling step is carried out in a tandem mill, the total reduction in thickness during passage through the final two stands is required to be not less than 25%. Usually, in downstream stages of a tandem hot rolling mill, a sheet is hot-rolled at a low reduction in thickness for shape correction and stability of sheet passage. However, a high reduction in thickness is required to realize both good workability (r-value) and stable strength at high temperatures.

Also, for strain accumulation and control of precipitates, the elapsed time between the final two stands is required to be held within 1.0 second. Thus, the pass schedule and the sheet passing speed must be adjusted so as to satisfy such a requirement.

If the elapsed time between the final two stands exceeds 1.0 second, the strain accumulated by rolling in the first of the final two stands would partly disappear due to heat during such a period of time, and hence the strain energy once introduced into the steel would contribute less to recrystallization of the steel.

Further, the linear pressure in the final pass is required to be not lower than 15 MN/m in addition to the foregoing requirements. The linear pressure can be determined by measuring the load with a load cell provided in the final mill stand, and dividing the measured load by the width of the hot-rolled sheet. The linear pressure during the hot rolling can be increased by any method such as increasing the reduction in thickness, lowering the hot rolling temperature, or increasing the strain rate (hot rolling speed). In any case, the greater the amount of strain accumulated, the easier are created points where dislocations occur that are entangled with each other, i.e., precipitation nuclei. Also, with the greater amount of strain accumulated, the effective diffusion coefficient is increased and hence recrystallization is accelerated, which contributes to developing good workability and stable strength at high temperatures.

Moreover, annealing a hot-rolled sheet at temperatures of 800 to 1050° C. makes it possible to achieve proper control of recrystallization and the solid solution of part of the precipitates. If the annealing temperature is lower than 800° C., the recrystallization would not progress sufficiently and the workability would be decreased. On the other hand, if the annealing temperature exceeds 1050° C., the r-value would be noticeably reduced due to a variation in the crystal orientation after the cold rolling.

The annealing time is not limited to a particular value, but it is preferably about 60 seconds. Note that the advantages of the present invention will not be impaired at all even by prolonging the annealing time for accelerating recrystallization and improving workability, or by carrying out box annealing as required.

In the present invention, as described above, the aspect ratio ($d_{RD}/d_{TD}$) of grain size in planes at ¼ and ¾ sheet thickness, seen in the direction normal to the sheet surface, must be controlled so as to satisfy the range of 1.03 to 1.35. Controlling the aspect ratio so as to satisfy the above range requires not only proper control of the hot rolling conditions and the annealing conditions for the hot-rolled sheet to the respective above-mentioned ranges, but also proper selection of the cold rolling conditions.

First, in at least the final pass of the cold rolling, the sheet temperature is required to be not lower than 80° C. If the sheet temperature is lower than 80° C., the aspect ratio would be increased and the workability would be decreased. Although the reason is not yet fully understood, it is deemed that strain is accumulated due to the aging effect of a material and the steel is hardened. On the other hand, if the rolling temperature in the final pass exceeds 200° C., temper color would be developed due to surface oxidation. Incidentally, the sheet temperature was measured using a radiation thermometer for low temperatures or a contact-type thermometer having a rotary measuring probe.

Then, the final pass of the cold rolling is required to be carried out as lubricated rolling with the coefficient of friction held in the range of 0.01 to 0.2. The reason is as follows. If the coefficient of friction exceeds 0.2, the effect of shearing deformation would be noticeable, thus resulting in both a decrease in workability and the formation of precipitates, and hence a decrease over time of the strength at high temperatures would be noticeable. On the other hand, if the coefficient of friction is less than 0.01, slippage would occur during the cold rolling, with the result that the rolling would be no longer continued. The coefficient of friction can be determined based on the Brand and Ford solution (see, e.g., Proc. Instn. Mech. Eng., 159(1948), P.144–153) from forward tension and backward tension during the rolling, a measured load value, and a value of deformation resistance of a material which has been determined beforehand.

Moreover, it is recommended that the reduction in thickness during the cold rolling be not less than 60% for the purpose of improving the r-value. However, if the reduction in thickness exceeds 90%, it would sometimes be difficult to obtain a stable high r-value.

Although other conditions are not necessarily limited to particular ones, the finish annealing conditions are advantageously set to be not lower than 650° C. and not shorter than 30 seconds for ensuring the completion of recrystallization. Regarding the annealing temperature, by setting it to be not lower than 650° C., recrystallization can progress sufficiently and good workability can be achieved. However, if the annealing temperature exceeds 1150° C., a drawback such as surface oxidation during the annealing would sometimes occur. For the same reasons as mentioned above, the annealing time is recommended to be maintained in the range of 30 to 300 seconds.

By satisfying all of the requirements described above, the aspect ratio ($d_{RD}/d_{TD}$) of grain size in planes at ¼ and ¾ sheet thickness can be properly controlled so as to fall in the range of 1.03 to 1.35. As a result, required characteristics, i.e., the Y.S.≦360 MPa and the r-value≧1.3 at 30° C., the Y.S.≧18.0 MPa after maintaining the steel sheet at 900° C. for one hour, and the $10^7$ fatigue limit≧42 MPa, are reliably obtained.

Depending on applications, the steel sheet of the present invention may be produced by descaling, e.g., pickling, the hot-rolled sheet after the annealing with the omission of cold rolling.

As a matter of course, superior characteristics can be similarly obtained even when the steel sheet produced by the present invention is formed into a steel pipe by any desired method.

EXAMPLE

Molten steel having the composition shown in Table 1 was produced in a conventional smelting furnace. Then, continuous casting was performed on the steel to obtain a continuously cast slab having a thickness of 200 mm. The slab was hot-rolled in a tandem rolling mill under the conditions shown in Table 2. After annealing the hot-rolled sheet, the sheet was subjected to cold rolling and finish annealing. Then, by descaling the finish-annealed sheet by pickling, a product sheet was obtained. Three specimens were sampled from each product sheet.

Each product sheet thus obtained was measured for the $d_{RD}/d_{TD}$ value, the Y.S. and the r-value at 30° C., and the Y.S.

after maintaining the specimen at 900° C. for one hour. The results are listed in Table 3. Table 3 also shows results of conducting a repeated bending test (by completely reversed bending) at 900° C. and measuring the $10^7$ fatigue limit (maximum bending stress at which no fatigue cracks occur even after repeating the bending $10^7$ times).

The Y.S. (corresponding to a tension set of 0.2%) at 30° C. and 900° C. was measured in conformity with JIS Z2241 and JIS G0567 respectively. The measured value after maintaining the specimen at 900° C. for one hour was obtained by carrying our the measurement in a similar manner after soaking the specimen for one hour.

Also, the r-value represents, as described above, the average plastic strain ratio determined in conformity with JIS Z2254.

Further, the aspect ratio was determined by evaluating a structure photograph of the plane at each of ¼ and ¾ sheet thickness by the segment method. Namely, two straight lines were drawn one in each of the RD and TD directions so as to extend over about 100 grains, and the quotients resulting from dividing lengths of the straight lines by the numbers of segments, corresponding to parts of the straight lines demarcated by the grain boundaries, were averaged to obtain average values $d_{RD}$, $d_{TD}$ of the grain sizes in the respective directions. Then, the aspect ratio (degree of elongation) of grain size in the RD direction to grain size in the TD direction was determined from the ratio of $d_{RD}/d_{TD}$.

As seen from the above description, according to the present invention, a ferritic stainless steel sheet which is superior in mechanical characteristics at high temperatures, particularly strength at high temperatures, and workability at room temperatures can be reliably produced.

TABLE 1

| Steel | Composition (mass %) | | | | | | | | | | | |
|---|---|---|---|---|---|---|---|---|---|---|---|---|
| Symbol | C | Si | Mn | Cr | Ni | Mo | Al | Nb | N | P | S | Others |
| A | 0.006 | 0.42 | 1.3 | 11.8 | 0.3 | 1.9 | 0.35 | 0.65 | 0.002 | 0.02 | 0.01 | |
| B | 0.015 | 0.85 | 0.6 | 13.5 | 0.6 | 1.5 | 0.06 | 0.24 | 0.004 | 0.05 | 0.01 | |
| C | 0.003 | 0.33 | 0.3 | 18.5 | 1.1 | 1.6 | 0.88 | 0.36 | 0.013 | 0.04 | 0.01 | |
| D | 0.009 | 0.22 | 0.4 | 14.1 | 0.8 | 1.8 | 0.25 | 0.52 | 0.006 | 0.03 | 0.01 | |
| E | 0.010 | 0.42 | 0.2 | 15.1 | 0.4 | 1.6 | 0.05 | 0.45 | 0.005 | 0.03 | 0.02 | |
| F | 0.004 | 0.35 | 0.3 | 15.3 | 0.5 | 1.5 | 0.04 | 0.53 | 0.004 | 0.05 | 0.01 | |
| G | 0.004 | 0.35 | 0.3 | 15.3 | 0.5 | 2.3 | 0.04 | 0.53 | 0.004 | 0.02 | 0.01 | |
| H | 0.004 | 0.35 | 0.3 | 15.3 | 0.5 | 0.8 | 0.04 | 0.53 | 0.004 | 0.02 | 0.01 | |
| I | 0.004 | 0.35 | 0.3 | 10.4 | 0.5 | 1.5 | 0.04 | 0.53 | 0.004 | 0.04 | 0.01 | |
| J | 0.007 | 0.38 | 0.8 | 13.8 | 0.4 | 1.5 | 0.32 | 0.55 | 0.005 | 0.02 | 0.01 | Ti: 0.42 |
| K | 0.003 | 0.40 | 0.6 | 14.9 | 0.7 | 1.3 | 0.31 | 0.53 | 0.008 | 0.01 | 0.02 | Zr: 0.22 |
| L | 0.007 | 0.42 | 0.4 | 14.5 | 0.3 | 1.6 | 0.22 | 0.71 | 0.014 | 0.03 | 0.01 | Ta: 0.08 |
| M | 0.007 | 0.42 | 0.6 | 14.5 | 0.2 | 1.8 | 0.05 | 0.35 | 0.006 | 0.02 | 0.01 | Cu: 1.2 |
| N | 0.005 | 0.41 | 0.6 | 14.1 | 0.3 | 1.6 | 0.25 | 0.43 | 0.007 | 0.02 | 0.03 | W: 0.65 |
| O | 0.006 | 0.44 | 0.7 | 14.3 | 0.3 | 1.5 | 0.27 | 0.48 | 0.007 | 0.02 | 0.02 | Mg: 0.004 |
| P | 0.005 | 0.43 | 0.7 | 13.9 | 0.5 | 1.5 | 0.14 | 0.52 | 0.009 | 0.05 | 0.01 | Ca: 0.002 |

TABLE 2-a

| No. | Steel Symbol | Type of Hot Rolling | Total Reduction in Thickness by Finish Final Two Stands (%) | Elapsed Time in Final Two Stands (s) | Final Pass Linear Pressure (MN/m) | Thickness of Hot-rolled Sheet (mm) | Annealing Temperature of Hot-rolled Sheet (° C.) | Annealing Time of Hot-rolled Sheet (s) | Reduction in Thickness by Cold Rolling (%) | Cold Rolling Final Pass: Temperature (° C.) | Cold Rolling Final Pass: Coefficient of Friction | Thickness of Cold-rolled sheet (mm) | Finish Annealing Temperature (° C.) | Finish Annealing Time (s) |
|---|---|---|---|---|---|---|---|---|---|---|---|---|---|---|
| 1 | A | tandem mill | 28 | 0.96 | 18 | 5.0 | 820 | 90 | 64 | 150 | 0.12 | 1.8 | 880 | 60 |
| 2 | B | | 26 | 0.72 | 25 | 1.9 | 1030 | 30 | 79 | 100 | 0.02 | 0.4 | 1050 | 40 |
| 3 | C | | 31 | 0.48 | 45 | 1.7 | 950 | 60 | 79 | 120 | 0.03 | 0.35 | 850 | 12000 |
| 4 | D | | 35 | 0.83 | 31 | 3.2 | 860 | 60 | 75 | 110 | 0.06 | 0.8 | 920 | 60 |
| 5 | | | | | | | 1070 | | | | | | 1050 | |
| 6 | | | | 1.21 | 33 | | 860 | | | | | | 920 | |
| 7 | E | | 28 | 0.85 | 14 | 4.5 | 1000 | 60 | 78 | 90 | 0.08 | 1.0 | 950 | 70 |
| 8 | | | | | 17 | | | | | | | | | |
| 9 | | | | | 20 | | | | | | | | | |
| 10 | | | | | 23 | 3.5 | | | 71 | | | | | |
| 11 | | | | | 26 | | | | | | | | | |
| 12 | F | | 31 | 0.66 | 24 | 3.0 | 1000 | 60 | 60 | 120 | 0.11 | 1.2 | 1020 | 70 |
| 13 | | | 21 | 0.86 | 17 | | | | | | | | | |
| 14 | | | 31 | 1.21 | 24 | | | 90 | | | | | | |
| 15 | | | | 0.66 | | | 760 | 120 | | | | | | |
| 16 | G | | 31 | 0.66 | 25 | 3.0 | 1000 | 60 | 60 | 120 | 0.16 | 1.2 | 1020 | 70 |

TABLE 2-b

| No. | Steel Symbol | Type of Hot Rolling | Total Reduction in Thickness by Finish Final Two Stands (%) | Elapsed Time in Final Two Stands (s) | Final Pass Linear Pressure (MN/m) | Thickness of Hot-rolled Sheet (mm) | Annealing Temperature of Hot-rolled Sheet (° C.) | Annealing Time of Hot-rolled Sheet (s) | Reduction in Thickness by Cold Rolling (%) | Cold Running Final Pass Temperature (° C.) | Cold Running Final Pass Coefficient of Friction | Thickness of Cold-rolled sheet (mm) | Finish Annealing Temperature (° C.) | Finish Annealing Time (s) |
|---|---|---|---|---|---|---|---|---|---|---|---|---|---|---|
| 17 | H | tandem mill | 31 | 0.66 | 19 | 3.0 | 1000 | 60 | 60 | 120 | 0.16 | 1.2 | 1020 | 70 |
| 18 | I | | | | | | | | | | | | | |
| 19 | F | | 31 | 0.66 | 24 | 3.0 | 1000 | 60 | 60 | 45 | 0.08 | 1.2 | 1020 | 70 |
| 20 | | | | | | | | | | 90 | 0.25 | | | |
| 21 | J | | 28 | 0.96 | 18 | 5.0 | 820 | 90 | 64 | 150 | 0.12 | 1.8 | 880 | 60 |
| 22 | K | | | | | | | | | | | | | |
| 23 | L | | | | | | | | | | | | | |
| 24 | M | | | | | | | | | | | | | |
| 25 | N | | | | | | | | | | | | | |
| 26 | 0 | | | | | | | | | | | | | |
| 27 | Q | | | | | | | | | | | | | |

TABLE 3-a

| No. | $d_{RD}/d_{TD}$ | Y.S. (30° C.) (MPa) | Y.S. (900° C.) (MPa) | r-value | $10^7$ Fatigue Limit (MPa) | Remarks |
|---|---|---|---|---|---|---|
| 1 | 1.20 | 343 | 19.5 | 1.4 | 45.5 | Inventive Example |
| 2 | 1.06 | 340 | 18.2 | 1.3 | 46.6 | Inventive Example |
| 3 | 1.29 | 321 | 18.6 | 1.3 | 44.4 | Inventive Example |
| 4 | 1.25 | 355 | 18.4 | 1.5 | 43.2 | Inventive Example |
| 5 | 0.98 | 335 | 16.3 | 1.1 | 28.1 | Comparative Example |
| 6 | 1.46 | 370 | 17.2 | 1.1 | 41.5 | Comparative Example |
| 7 | 1.40 | 362 | 17.5 | 1.1 | 38.4 | Comparative Example |
| 8 | 1.28 | 355 | 18.1 | 1.3 | 43.6 | Inventive Example |
| 9 | 1.30 | 355 | 18.3 | 1.4 | 45.3 | Inventive Example |
| 10 | 1.26 | 351 | 18.5 | 1.4 | 44.0 | Inventive Example |
| 11 | 1.24 | 343 | 18.8 | 1.5 | 42.8 | Inventive Example |
| 12 | 1.32 | 358 | 20.2 | 1.3 | 42.4 | Inventive Example |
| 13 | 1.45 | 340 | 17.6 | 1.1 | 39.9 | Comparative Example |
| 14 | 1.52 | 333 | 16.9 | 1.2 | 38.5 | Comparative Example |
| 15 | 1.85 | 333 | 15.2 | 0.9 | 36.7 | Comparative Example |
| 16 | 1.33 | 382 | 20.1 | 1.4 | 42.8 | Comparative Example |
| 17 | 1.40 | 328 | 16.7 | 1.3 | 40.9 | Comparative Example |
| 18 | 1.28 | 320 | 15.5 | 1.4 | 43.3 | Comparative Example |
| 19 | 1.42 | 352 | 17.5 | 1.1 | 41.1 | Comparative Example |
| 20 | 1.01 | 350 | 16.8 | 1.2 | 38.5 | Comparative Example |
| 21 | 1.21 | 343 | 19.3 | 1.4 | 45.3 | Inventive Example |

TABLE 3-b

| No. | $d_{RD}/d_{TD}$ | Y.S. (30° C.) (MPa) | Y.S. (900° C.) (MPa) | r-value | $10^7$ Fatigue Limit (MPa) | Remarks |
|---|---|---|---|---|---|---|
| 22 | 1.18 | 341 | 19.3 | 1.3 | 46.1 | Inventive Example |
| 23 | 1.18 | 343 | 19.1 | 1.5 | 44.4 | Inventive Example |
| 24 | 1.19 | 345 | 19.2 | 1.5 | 44.6 | Inventive Example |
| 25 | 1.22 | 344 | 19.5 | 1.6 | 44.6 | Inventive Example |
| 26 | 1.23 | 344 | 19.4 | 1.3 | 45.0 | Inventive Example |
| 27 | 1.18 | 350 | 19.2 | 1.4 | 45.2 | Inventive Example |

What is claimed is:

1. A ferritic stainless steel sheet having superior workability at room temperatures and mechanical characteristics at high temperatures, wherein said stainless steel sheet has a composition containing, by weight percent, C: not more than 0.02%, Si: 0.2 to 1.0%, Mn: not more than 1.5%, Cr: 11.0 to 20.0%, Ni: 0.05 to 2.0%, Mo: 1.0 to 2.0%, l: not more than 1.0%, Nb: 0.2 to 0.8%, and N: not more than 0.02%, balance essentially Fe, and an aspect ratio ($d_{RD}/d_{TD}$) of grain size in planes at ¼ and ¾ sheet thickness, seen in a direction normal to a sheet surface, that satisfies the following equation:

$$1.03 \leqq (d_{RD}/d_{TD}) \leqq 1.35$$

where $d_{RD}$: average grain size in a rolling direction (RD direction) seen in a direction normal to the sheet surface, and $d_{TD}$: average grain size in a transverse direction (TD direction) perpendicular to the RD direction seen in a direction normal to the sheet surface.

2. A ferritic stainless steel sheet according to claim 1, wherein said steel sheet has a thickness greater than 0.3 mm but not greater than 2.5 mm, and a strength Y.S.≦360 MPa and an r-value≧1.3 at 30° C., and wherein after maintaining said steel sheet at 900° C. for one hour, the Y.S.≧18.0 MPa.

3. A ferritic stainless steel sheet according to claim 1, wherein P+S≦0.05 wt %.

4. A ferritic stainless steel sheet according to claim 1, wherein said steel sheet has a composition further containing, by weight percent, at least one of:

Ti: 0.05 to 0.5%, Zr: 0.05 to 0.5%, and Ta: 0.05 to 0.5%.

5. A ferritic stainless steel sheet according to claim 1, wherein said steel sheet has a composition further containing, by weight percent, Cu: 0.1 to 2.0%.

6. A ferritic stainless steel sheet according to claim 1, wherein said steel sheet has a composition further containing, by weight percent, at least one of:

W: 0.05 to 1.0% and Mg: 0.001 to 0.1%.

7. A ferritic stainless steel sheet according to claim 1, wherein said steel sheet has a composition further containing, by weight percent, Ca: 0.0005 to 0.005%.

* * * * *

UNITED STATES PATENT AND TRADEMARK OFFICE

CERTIFICATE OF CORRECTION

PATENT NO. : 6,521,056 B2 
DATED : February 18, 2003
INVENTOR(S) : Mineo Muraki et al.

It is certified that error appears in the above-identified patent and that said Letters Patent is hereby corrected as shown below:

Column 14,
Line 50, change "1:" to -- A1: --.

Signed and Sealed this

Sixth Day of May, 2003

JAMES E. ROGAN
*Director of the United States Patent and Trademark Office*